United States Patent [19]

Nagahori

[11] Patent Number: 5,039,844

[45] Date of Patent: Aug. 13, 1991

[54] PTC DEVICES AND THEIR PREPARATION

[75] Inventor: Atsushi Nagahori, Ibaraki, Japan

[73] Assignee: Nippon Mektron, Ltd., Tokyo, Japan

[21] Appl. No.: 239,765

[22] Filed: Sep. 29, 1988

Related U.S. Application Data

[62] Division of Ser. No. 19,158, Feb. 26, 1987, Pat. No. 4,787,135.

[30] Foreign Application Priority Data

Mar. 31, 1986 [JP] Japan ..... 61-73728

[51] Int. Cl.[5] ..... H05B 3/12

[52] U.S. Cl. ..... 219/541; 219/505; 219/93; 219/94; 338/22 R

[58] Field of Search ..... 219/86.9, 93, 94, 91.2, 219/541, 118, 542, 504, 505, 546, 548, 549, 552, 553; 338/22 R; 29/612, 883, 844

[56] References Cited

U.S. PATENT DOCUMENTS

| | | | |
|---|---|---|---|
| 3,231,710 | 1/1966 | Barnet | 219/86.9 |
| 4,650,951 | 3/1987 | Koga | 219/91.2 |
| 4,787,135 | 11/1988 | Nagahori | 219/93 |

FOREIGN PATENT DOCUMENTS

| | | | |
|---|---|---|---|
| 3815469 | 8/1963 | Japan | 219/93 |
| 0094478 | 6/1982 | Japan | 219/93 |

*Primary Examiner*—Bruce A. Reynolds
*Assistant Examiner*—Leon K. Fuller
*Attorney, Agent, or Firm*—Wegner & Bretschneider

[57] ABSTRACT

A process for producing a PTC device comprising the steps of forming a laminate comprising a PTC composition and at least two electrode plates having the PTC composition sandwiched therebetween, opposing the surface of a lead plate to be electrically connected to each of the electrodes, to the surface of each of the electrode plates of the laminate while contacting at a narrow area, and then passing a current between the electrode and the lead via the narrow contact surface to weld them. By this process, there is obtained a PTC device having, at a portion of the joining interface between each electrode plate and each lead plate, a nugget formed by melting both the plates. This PTC device has a low contact resistance between the PTC composition and the electrode plates.

5 Claims, 2 Drawing Sheets

PTC DEVICES AND THEIR PREPARATION

This application is a division of Ser. No. 019,158, filed Feb. 26, 1987, now U.S. Pat. No. 4,782,135.

BACKGROUND OF THE INVENTION

This invention relates to an electrical resistance device and, more particularly, to a resistance device having specific properties of sharply increased electrical resistance as temperature increases, within a relatively narrow temperature range i.e., to a PTC (positive temperature coefficient) device.

Materials having PTC characteristics can be utilized in a control device by which heat generation is ceased when a heater reaches a high temperature, in a PTC thermistor, in a heat-sensitive sensor or in a protection device wherein when an excessive current flows through a circuit due to short or the like the current is increased and therefore self-heating is developed by Joule heat. In such a circuit the resistance of the PTC protection device is increased to restrict the current to a predetermined value or less, whereas when the short is released the circuit is restored. A variety of materials have been developed as the materials having PTC characteristics. For example, one type of material having PTC characteristics is a ceramic-type material comprising $BaTiO_3$ having a monovalent or trivalent metal oxide incorporated therein, and a polymer-type material comprising a polymer such as polyethylene having an electrically conductive material such as carbon black dispersed therein.

As shown in FIG. 3, a PTC device generally comprises a material having PTC characteristics 2 consisting of a polymer having an electrically conductive material dispersed therein (a PTC composition), metallic electrode plates 3*a* and 3*b* having the PTC composition sandwiched or interposed therebetween, and lead plates 4*a* and 4*b* connected to the electrode plates 3*a* and 3*b*, respectively. Each electrode plate is connected to a separate device, apparatus, power source or the like via each lead plate.

The PTC device is obtained by first preparing a PTC composition, forming this PTC composition into a film, hot pressing metallic foil electrodes to upper and lower surfaces of the film to form a laminate, cutting this laminate into a predetermined size, and providing a lead plate on the surface of each of the electrodes by soldering, welding or the like. The joining between the PTC composition and the electrode plates is carried out by hot pressing the PTC composition to the electrode plates at a temperature close to the melting point of the PTC composition.

It is desirable that the PTC device exhibits a resistance value as low as possible at room temperature (a room temperature resistance) and a resistance value as high as possible at a high temperature (a peak resistance). The room temperature resistance is primarily dependent on the type of the PTC composition and the adhesion between the PTC composition and the surface of each electrode. In order to reduce the room temperature resistance, the amount of the electrically conductive particles packed in the PTC composition can be increased. However, in this case, the peak resistance is decreased and therefore it is impossible to obtain a high ratio of peak resistance to room temperature resistance. In order to improve the adhesion between the PTC composition and the surface of each electrode, a process for decreasing the contact resistance between the PTC composition and each electrode has been proposed (U.S. Pat. Nos. 4,238,812 and 4,426,339).

In electrically connecting the lead plates to each electrode of the PTC device by soldering, welding or the like, the whole of the PTC device is heated. Because of the heat, a portion of the PTC composition is pyrolyzed, causing such as gas evolution, heat deterioration or weakening of the bond between the PTC composition and the electrode plates. Because of this heat damage, the adhesion between the PTC composition and the electrodes is impaired, thus increasing the contact resistance therebetween.

SUMMARY OF THE INVENTION

A general object of the present invention is to provide a PTC device having a lower room temperature resistance while maintaining a high peak resistance.

Another object of the present invention is to provide a process for preparing an excellent PTC device having a lower value of room temperature resistance wherein the heat damage during welding of the electrode plates and lead plates of the PTC device is alleviated and the contact resistance is decreased.

Other objects of the present invention and advantages of the present invention will become apparent to those skilled in the art from the following disclosure and the appended claims.

According to the present invention, the objects described above are accomplished by forming a laminate comprising a PTC composition and at least two electrode plates having said PTC composition sandwiched therebetween, opposing the surface of a lead plate to be electrically connected to each of said electrodes, to the surface of each of said electrode plates of said laminate while contacting at a narrow area, and then passing a current between said electrode and said lead via the narrow contact surface to weld them.

According to another embodiment of the present invention, a PTC device of the present invention comprises a PTC composition, at least two electrode plates having said PTC composition sandwiched therebetween and intimately joined thereto, and a lead plate joined to the surface of each of the electrode plates, wherein said PTC device has, at a portion of the joining interface between each of said electrode plates and each of said lead plates, a nugget formed by melting both the plates.

DETAILED DESCRIPTION OF THE INVENTION

Figure 1:
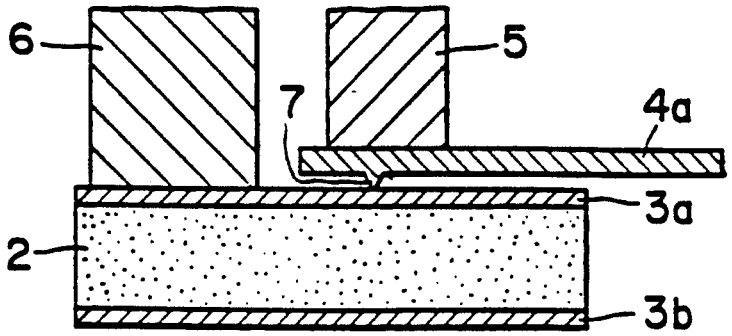
FIG. 1 is a sectional view illustrating a process according to the present invention.

A PTC device according to the present invention preferably comprises at least two electrodes, a PTC composition disposed between the electrodes, and a lead fixed to each of the electrodes. Examples of such PTC compositions include $BaTiO_3$ having a monovalent or trivalent metal oxide incorporated therein, and a mixture of a polymer and electrically conductive particles.

Examples of the polymers which can be used in the present invention include polyethylene, polyethylene oxide, polybutadiene, polyethylene acrylates, ethylene-ethyl acrylate copolymers, ethylene-acrylic acid copolymers, polyesters, polyamides, polyethers, polycaprolactam, fluorinated ethylene-propylene copolymers, chlorinated polyethylene, chlorosulfonated polyethylene, ethyl-vinyl acetate copolymers, polypropylene, polystyrene, styrene-acrylonitrile copolymers, polyvinyl chloride, polycarbonates, polyacetals, polyalkylene oxides, polyphenylene oxide, polysulfones, fluoroplastics, and blend polymers of at least two polymers selected from the polymers described above. In the present invention, the type of the polymers and compositional ratios can be varied depending on desired performance, uses or the like.

Examples of electrically conductive particles dispersed in the polymer which can be used in the present invention are particles of electrically conductive materials such as carbon black, graphite, tin, silver, gold, and copper.

In preparing the PTC composition, optional various additives can be used in addition to the polymer and the electrically conductive particles described above. Such additives include flame retardants such as antimony-containing compounds, phosphorus-containing compounds, chlorinated compounds and brominated compounds, antioxidants and stabilizers.

The PTC composition according to the present invention is preferably prepared by blending and kneading its raw materials, the polymer, the electrically conductive particles and other additives in predetermined ratios.

The PTC device of the present invention comprises the PTC composition described above and at least two electrodes which are in contact with the PTC composition. Such electrode materials which can be used herein are metals which can be used as conventional electrodes. Examples of such electrode materials include nickel, cobalt, aluminum, chromium, tin, copper, silver, iron (including iron alloys such as stainless steel), zinc, gold, lead, and platinum. The shape and size of the electrodes can desirably be varied depending on uses of the PTC device or the like. In the present invention, the surface of the metallic electrode can be subjected to electrodeposition treatment or the like to form a rough surface, thereby providing a number of fine projections thereon. Such projections are provided on at least the surface of the electrode which comes into contact with the PTC composition.

One embodiment of a process for producing a PTC device will be described.

A PTC device can be produced by forming the resulting composition into, for example, a film, hot pressing the metallic electrodes to upper and lower surfaces of the film to form a laminate, cutting this laminate into a predetermined size, and joining and fixing a lead to the surface of each of the electrodes by spot welding.

In the step of joining the electrodes and the leads according to the present invention, the surface of a lead plate to be electrically connected to each of said electrodes is opposed to the surface of each electrode plate while contacting over only a narrow area, and a current is then passed between said electrode and the lead via the narrow contact surface to weld them. In the present invention, the contact at a narrow area can be carried out in various embodiments. Examples of such embodiments include an embodiment wherein one or more projections have been formed in a plate material for making the leads by means of a punch or the like and such projections are brought into contact with the surface of the electrode. In another embodiment, one or more projections have been formed in the electrode plate and such projections are brought into contact with the surface of the lead plate. In a third embodiment, pieces of welding material are interposed between the electrode plate and lead plate. In joining the leads to the electrode plates it is desirable that pressure is applied to the lead plate in a direction toward the side of the electrode plate while passing a current. This embodiment can render the joining between the lead plate and the electrode plate firm.

Figure 2:
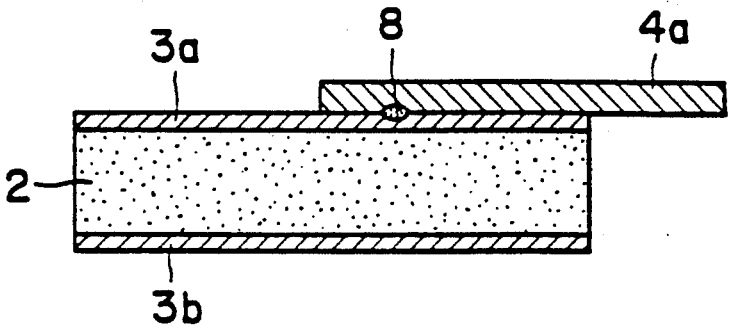
FIG. 2 is a sectional view showing an embodiment of a PTC device according to the present invention.
Figure 3:
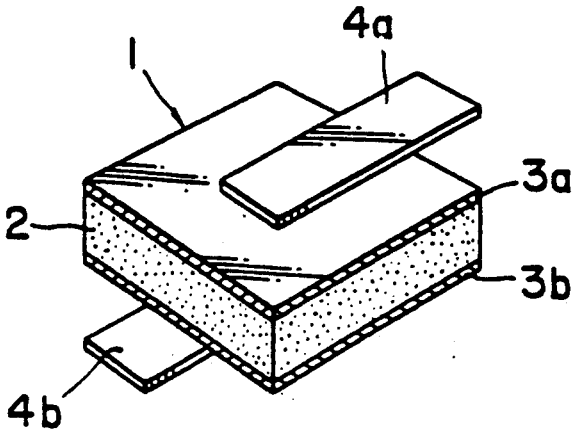
FIG. 3 PRIOR ART
FIG. 3 is a perspective view of a general PTC device.
Figure 4:
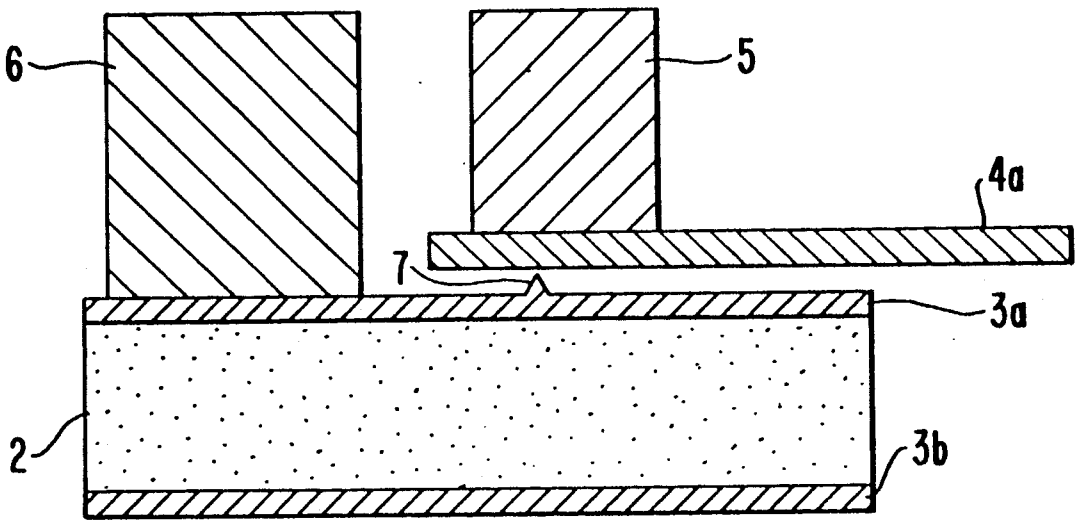
FIG. 4 is a sectional view similar to FIG. 1 illustrating a second embodiment of the present invention.

The joining between the electrode plate and the lead plate according to the present invention is described with reference to FIGS. 1 and 2. A laminate comprising a PTC composition 2 and two electrode plates 3*a* and 3*b* having the PTC composition 2 sandwiched therebetween is provided. A welding electrode 6 having a wide contact area is brought into contact with the surface of the upper electrode plate 3*a* of the laminate. On the other hand, a projection 7 has been formed on the lower surface of the lead plate 4*a* by means of a punch or the like, and the tip of the projection 7 is brought into contact with the electrode plate 3*a*. The lead plate 4*a* is downwardly pushed by a welding electrode 5. In such a state, a current is passed through the welding electrodes 5 and 6 to flow a large current (e.g., from 100 to 2,000 amps) through the projection 7 for a short period of time. The projection 7 is melted by Joule heat across the electrode plate 3*a* and the lead plate 4*a*. When the molten portion is solidified, a nugget 8 is formed as shown in FIG. 2. Thus, the electrode plate 3*a* and the lead plate 4*a* are joined.

Because welding is carried out over such a narrow contact area, a large current is concentrated in this narrow portion and only this portion is melted within a short period of time. The heat generated at this time is effectively utilized for welding. After welding, the heat can be rapidly dissipated and therefore it is possible to minimize heat damage due to welding.

In the present invention, an optional resin film can be formed on the surface of the PTC device. Examples of resins from which the resin film is produced include epoxy resins, phenolic resins, polyethylene, polypropylene, polystyrene, polyvinyl chloride, polyvinyl acetate, polyvinyl alcohol, acrylic resins, fluoroplastics, polyamide resins, polycarbonate resins, polyacetal resins, polyalkylene oxides, saturated polyester resins, polyphenylene oxide, polysulfones, poly-para-xylene, polyimides, polyamide-imides, polyester imides, polybenzimidazole, polyphenylene sulfides, silicone resins, urea resins, melamine resins, furan resins, alkyd resins, unsaturated plyester resins, diallyl phthalate resins, polyurethane resins, blend polymers thereof, and modified resins wherein the resins described above are modified by reaction of the resin with a chemical reagent, by crosslinkage with radiation, by copolymerization or the like. Of these resins, preferred resins are epoxy resins and phenolic resins. Various additives such as plasticizers, curing agents, crosslinking agents, antioxidants, fillers, antistatic agents and flame retardants can be incorporated in the resins. The resins used in the present invention have at least electrically insulating properties and have adhesion properties to the surface of the PTC device. Processes for coating the resin are not limited, and coating can be carried out by spraying, spreading, dipping or the like. Further, after coating the resin, curing can be carried out by a process such as chemical treatment, heating or radiation irradiation. The curing processes can be varied depending on the type of the resins.

EXAMPLES

In order to indicate more fully the nature and utility of this invention, the following examples are set forth, it being understood that these examples are presented as illustrative only and are not intended to limit the scope of the invention. All percentages used herein are by weight unless otherwise specified.

EXAMPLE 1

A PTC composition comprising the following components was prepared.

| Component | % |
|---|---|
| Polymer: high density polyethylene (available from Tokyo Soda Co. under the tradename Niporon Hard 5100) | 60 |
| Electrically conductive particles: carbon black (available from Cabot Co. under the tradename STERLING V) | 38 |
| Additive: antioxidant (Irganox 1010) | 2 |

This composition was kneaded by means of a twin-roll mill and formed into a film having a thickness of 300 micrometers by means of an extrusion molding machine or roll molding machine. Nickel foil electrodes having a thickness of 60 micrometers were hot pressed to the upper and lower surfaces of the film to form a laminate. Preferably, the surface of the electrodes is rendered rough. The resulting laminate was cut into a predetermined size (10×10×0.40 mm).

On the other hand, a nickel plate having a thickness of about 100 micrometers was provided and two projections each having a diameter of from 0.1 to 0.2 millimeter were formed in the nickel plate by means of a punch. The projections were superposed on the PTC electrode and a welding electrode having a wide contact surface was mounted on the lead plate. As shown in FIG. 1, a separate welding electrode was mounted on the PTC electrode so that it did not come into contact with the lead plate. In such a state, welding was carried out under the following welding conditions: an output of a welding electric power of 5 W.s, an electrode pressure of 2 kgf, and a current pass time of from 0.5 to 2.0 milliseconds to obtain a PTC device.

The room temperature resistance of the PTC device before welding was 50 milliohms and the room temperature resistance of the PTC device after welding was 55 milliohms. Accordingly, an increase in room resistance could be suppressed within 5 milliohms.

EXAMPLE 2 (COMPARATIVE EXAMPLE)

A PTC device was prepared as in Example 1 except that the joining between each lead plate and each electrode plate was carried out by soldering. The room temperature resistance of the resulting PTC device was greatly increased from 50 milliohms (before welding) to 254 milliohms (after welding).

What is claimed is:

1. A PTC device comprising a PTC composition which comprises a polymer and electrically conductive particles, at least two electrode plates having said PTC composition sandwiched therebetween and intimately joined thereto, and a lead plate joined to the surface of the electrode plates, wherein said PTC device has, at a portion of the joining interface between said electrode plates and said lead plate, a nugget formed by melting both the plates at a narrow contact surface, the device being substantially free from the heat of the melting.

2. The PTC device according to claim 1, wherein the nugget is formed by passing a current between the electrode plate and the lead plate via the narrow contact surface to weld them, the device being substantially free of heat damage from the welding.

3. The PTC device according to claim 2, wherein pressure is applied to the lead plate in a direction toward the electrode plates while passing a current.

4. The PTC device according to claim 3, wherein at least one projection is formed on the surface of the lead plate prior to welding.

5. The PTC device according to claim 2, wherein at least one projection is formed on the outer surface of one of said electrode plates prior to welding.

* * * * *